US009493898B2

(12) United States Patent
Kim et al.

(10) Patent No.: US 9,493,898 B2
(45) Date of Patent: Nov. 15, 2016

(54) DRUM TYPE WASHING MACHINE

(71) Applicant: Dongbu Daewoo Electronics Corporation, Seoul (KR)

(72) Inventors: In Dong Kim, Seoul (KR); Jeong Hyeon Kim, Seoul (KR); Hye Ung Kim, Seoul (KR); Ju Dong Lee, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 114 days.

(21) Appl. No.: 14/170,492

(22) Filed: Jan. 31, 2014

(65) Prior Publication Data

US 2015/0184327 A1 Jul. 2, 2015

(30) Foreign Application Priority Data

Dec. 26, 2013 (KR) ..... 10-2013-0164185

(51) Int. Cl.

| | |
|---|---|
| ***D06F 37/26*** | (2006.01) |
| ***D06F 39/12*** | (2006.01) |
| ***D06F 37/04*** | (2006.01) |
| *D06F 37/22* | (2006.01) |

(52) U.S. Cl.

CPC ..... *D06F 37/26* (2013.01); *D06F 37/04* (2013.01); *D06F 39/12* (2013.01); *D06F 37/22* (2013.01)

(58) Field of Classification Search

CPC ..... D06F 37/26

See application file for complete search history.

(56) References Cited

U.S. PATENT DOCUMENTS

| | | | |
|---|---|---|---|
| 3,199,319 | A | 8/1965 | Lowes |
| 4,499,744 | A | 2/1985 | Kotter et al. |
| 2005/0097924 | A1 | 5/2005 | Kim et al. |

FOREIGN PATENT DOCUMENTS

| | | | | | |
|---|---|---|---|---|---|
| DE | 202004003814 | U1 | | 6/2004 | |
| DE | 10339604 | B3 | | 10/2004 | |
| EP | 0101823 | A1 | | 3/1984 | |
| GB | 949845 | A | | 2/1964 | |
| JP | 2000005486 | A | * | 1/2000 | ..... D06F 39/12 |
| JP | 2004-81733 | | | 3/2004 | |
| KR | 10-2006-0103977 | | | 10/2006 | |

OTHER PUBLICATIONS

Korean Patent Abstracts, Publication No. 10-2006-0103977, Published Oct. 9, 2006, KIPO, Republic of Korea.

Extended European Search Report dated Jul. 17, 2015 issued in corresponding European Patent Application No. 14177066.9.

Chinese Office Action dated May 11, 2016 issued in corresponding Chinese Patent Application No. 201410049198.2 and English translation thereof.

* cited by examiner

*Primary Examiner* — Michael Barr
*Assistant Examiner* — Jason Riggleman

(57) ABSTRACT

A drum type washing machine includes a main body including a cabinet, a drum in the cabinet having a rotational axis thereof parallel with the ground, and a motor configured to drive or rotate the drum; and an angle adjusting unit configured to adjust an angle of the main body from the ground and/or tilt the main body up to the angle, wherein the angle adjusting unit includes a base configured to support the main body and a driver on the base configured to tilt or raise the main body, and the angle adjusting unit is configured to tilt the main body at a rear lower end of the cabinet.

14 Claims, 5 Drawing Sheets

DRUM TYPE WASHING MACHINE

CROSS-REFERENCE TO RELATED APPLICATIONS

This application is based on and claims priority from Korean Patent Application No. 10-2013-0164185, filed on Dec. 26, 2013, the disclosure of which is incorporated herein in its entirety by reference.

TECHNICAL FIELD

The present disclosure relates to a drum type washing machine.

BACKGROUND

Generally, a drum type washing machine washes the laundry placed in the washing machine through a door provided at a front side of the washing machine, with relatively small amounts of water and detergent.

The drum type washing machine may include a cabinet that defines the outer appearance of the washing machine; a tub in the cabinet configured to hold water; a rotatable drum in the tub configured to hold laundry; a motor located inside, behind or under the tub to rotate the drum, a water feeder that supplies water to the tub, and a drain configured to drain water from the tub to the outside of the cabinet after a washing operation is completed.

The drum generally rotates about a horizontal axis. In addition, the door of the washing machine is at a front side of the cabinet.

Therefore, when a user places the laundry in the drum or takes the washed laundry out of the drum, it is inconvenient for the user to bend his/her body.

Furthermore, when the user takes out a large amount of the laundry, the user's back may become strained or injured.

Also, it is difficult to check the remaining laundry located in the innermost section of the drum.

A conventional drum type washing machine may be disclosed in Korean Patent Publication No. 2006-0103977 (published on Oct. 9, 2006).

SUMMARY

The present disclosure provides a drum type washing machine capable of readily placing laundry into a drum and removing laundry out of the drum.

Exemplary embodiments of the present disclosure provide a drum type washing machine comprising a main body including a cabinet, a drum in the cabinet having a rotational axis thereof parallel with the ground, and a motor configured to drive or rotate the drum; and an angle adjusting unit configured to adjust an angle of the main body from the ground and/or tilt the main body up to the angle, wherein the angle adjusting unit includes a base configured to support the main body and a driver on the base configured to tilt or raise the main body, and the angle adjusting unit is configured to tilt the main body at a rear lower end of the cabinet (e.g., the main body and/or the cabinet comprises a hinge or pivot at the rear lower end of the cabinet).

A rotational shaft (e.g., that acts as a hinge or pivot for tilting the main body) may be oriented side to side, horizontally to the ground, and/or perpendicular to a rotational axis of the drum, and the base may have a guide groove, in which the rotational shaft rotates, moves and/or slides along a front-to-rear direction of the cabinet.

The driver may be a cylinder device (e.g., a hydraulic cylinder or other piston-based device), and the cylinder device may be spaced apart or separated from a rotational axis of the main body, so that the cylinder device may tilt the cabinet up and down (or the main body).

The cylinder device may include a piston configured to reciprocate bidirectionally, and an end of the piston may be connected to a lower surface or section of the cabinet that may be tilted up and down.

The end of the piston may be connected to a hinge that may rotate, or slide forward and backward, at a lower section of the cabinet.

The cylinder device may be rotatably connected to the base.

The cabinet may include a front blocking plate at a front surface of the cabinet to block a front space between the cabinet and the base, and one or more side blocking plates at respective side surface(s) of the cabinet to block a side space between the cabinet and the base.

The side blocking plate(s) may be at side surface(s) of the cabinet to cover and protect the rotational shaft.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
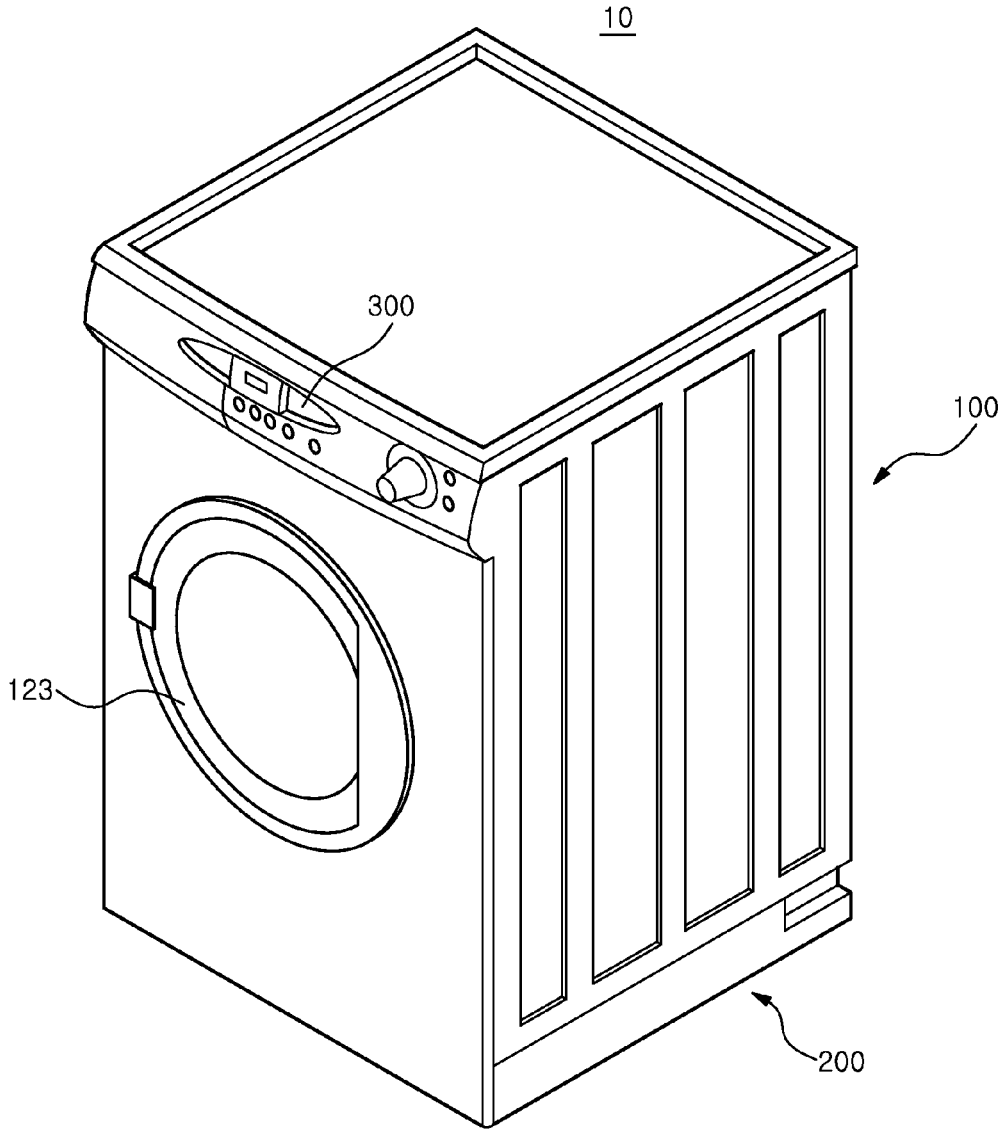
FIG. 1 is a perspective view of a drum type washing machine according to exemplary embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here. Exemplary embodiments of the present disclosure will be described more fully hereinafter with reference to the accompanying drawings, in which the exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein. It is noted that the drawings are schematic and are not necessarily dimensionally illustrated. Relative sizes and proportions of parts in the drawings may be exaggerated or reduced in their sizes, and a predetermined size is just exemplificative and not limitative. The same reference numerals designate the same structures, elements, or parts illustrated in two or more drawings in order to exhibit similar characteristics. The exemplary embodiments of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form by manufacturing.

Hereinafter, the embodiments of the present disclosure will be described in detail with reference to accompanying drawings.

Figure 2:
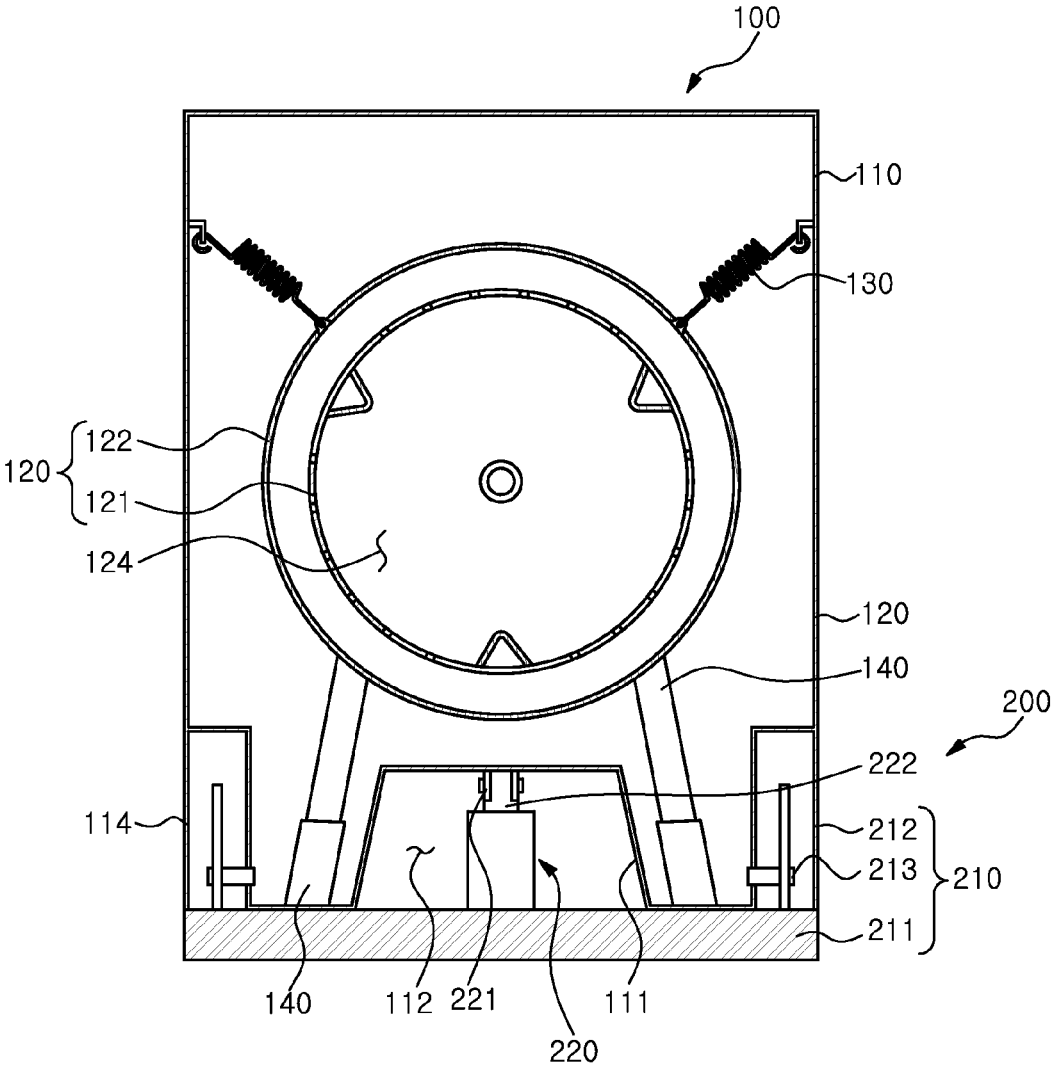
FIG. 2 is a cross-sectional view schematically illustrating a front surface of the exemplary washing machine of FIG. 1.
Figure 3:
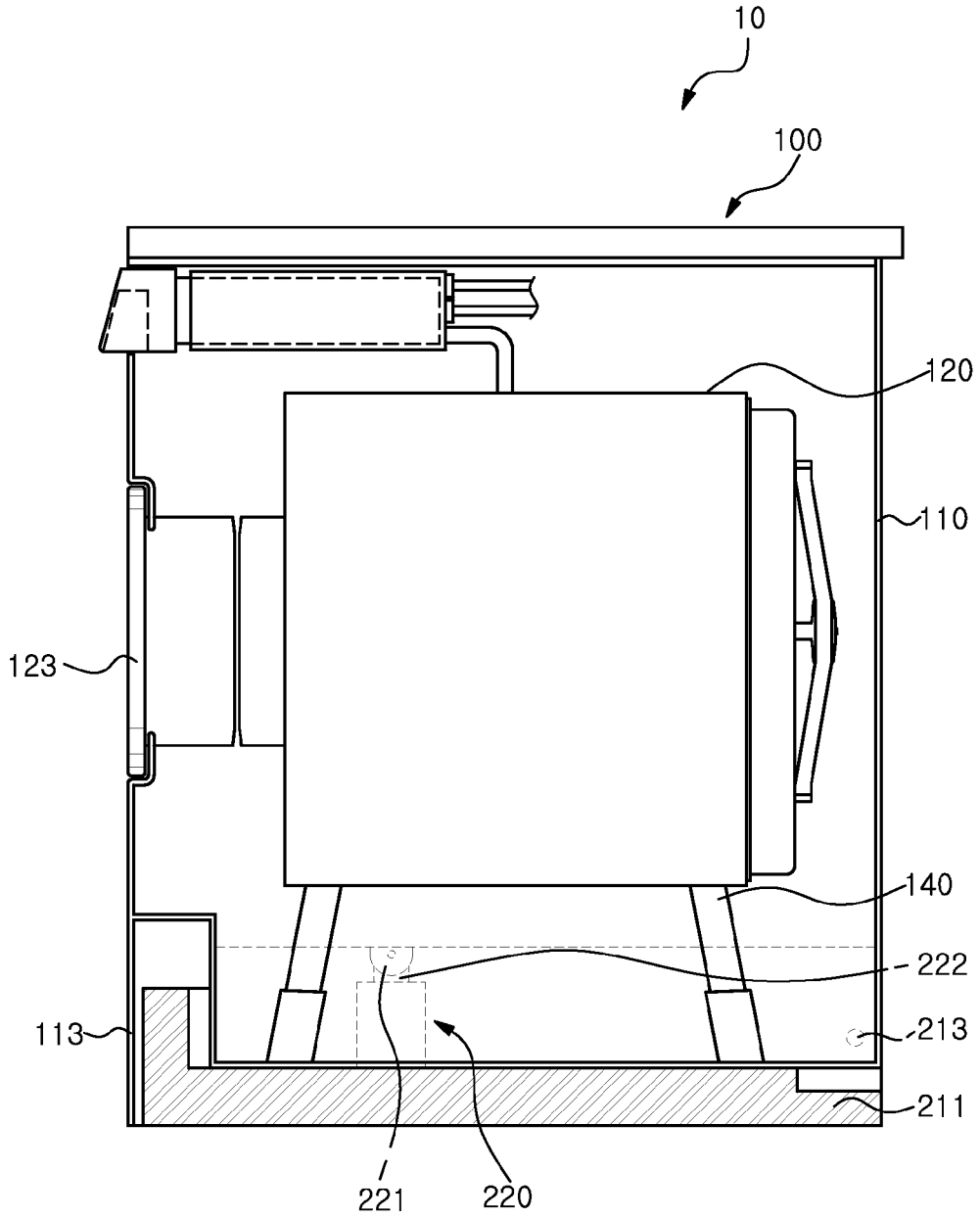
FIG. 3 is a cross-sectional view schematically illustrating a side surface of the exemplary washing machine of FIG. 1.
Figure 4:
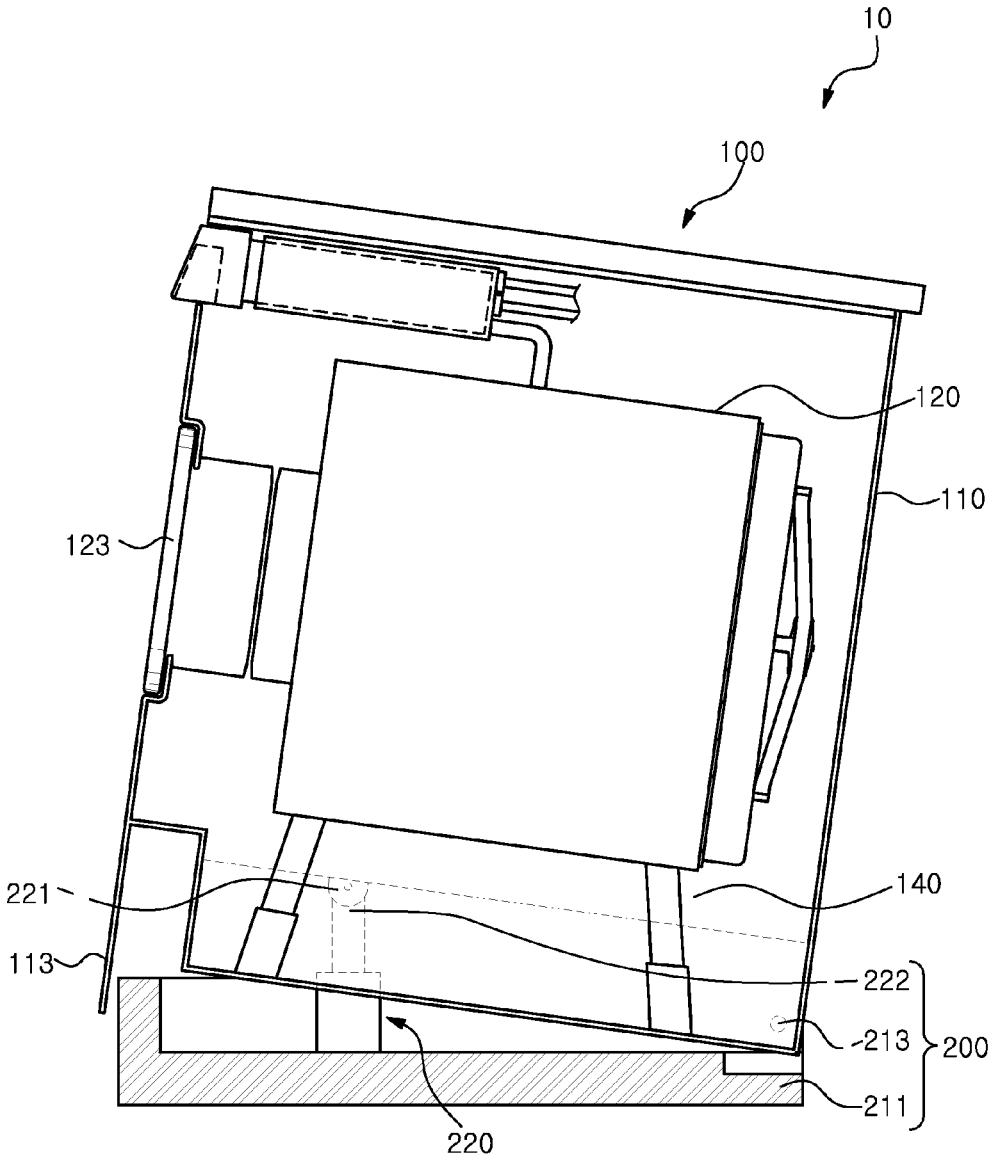
FIG. 4 is a view illustrating a tilted exemplary washing machine of FIG. 3.

FIG. 1 is a perspective view of a drum type washing machine according to exemplary embodiments of the present disclosure, FIG. 2 is a cross-sectional view schematically illustrating a front surface of the exemplary washing machine of FIG. 1, FIG. 3 is a cross-sectional view schematically illustrating a side surface of the exemplary washing machine of FIG. 1, and FIG. 4 is a view illustrating a tilted exemplary washing machine of FIG. 3.

Referring to FIGS. 1 to 4, a drum type washing machine 10 according to exemplary embodiments of the present disclosure includes a main body 100, an angle adjusting unit 200 and a control panel 300. Hereinafter, for purpose of explaining each element of the drum type washing machine 10, the side having a door 123 is designated as a front side, and an opposite side thereof is designated as a rear side.

The main body 100 may include a cabinet 110 defining an exterior of the drum type washing machine 10, and a washing unit 120 configured to wash laundry.

The cabinet 110 serves to receive and support the washing unit 120 and thus has a shape that is capable of receiving the washing unit 120. The cabinet 110 may have a hexahedral shape and may include a bent or sloped surface 111 such that a part of a bottom surface of the cabinet 110 protrudes upwardly. When the cabinet 110 is placed on a base of the angle adjusting unit 200, an installation space 112 may be between the bent or sloped surface 111 and the base 210 such that a driver 220 of the angle adjusting unit 200 may be located inside the installation space 112. A front blocking plate 113 that blocks the space between the cabinet 110, when tilted, the base 210 may be at a front surface of the cabinet 110, and one or more side blocking plate(s) 114 that block a side space between the cabinet 110 and the base 210 may be provided at respective side surface(s) of the cabinet 110. The one or more side blocking plate(s) 114 are at a side surface of a rotational shaft 213, and may cover and/or protect the rotational shaft 213.

The control panel 300 having buttons, knobs or the like enables a user to select a washing function or an angle adjusting function that enables the main body 100 to be pivoted upwardly or returned to its original position, may be on the front surface or an upper surface of the cabinet 110.

The washing unit 120 is in the cabinet 110, and may include a drum 121 inside the cabinet 110, to be rotated by a motor of which a horizontal shaft extends in a front-to-rear direction, and a tub 122 configured to support and/or surround the drum 121. The drum 121 may be rotated horizontally about a rotational axis parallel with the ground, extending between the front surface of the main body 100 and the rear surface of the main body 100. The drum 121 may have a cylindrical shape of which the front surface is open, and the open front surface may be closed by the door 123 of the washing machine. The drum 121 has a washing space 124 in which the laundry may be washed.

An upper surface or section of the tub 122 configured to support the drum 121 may be fixed to the cabinet 110 by an elastic fixing member 130 such as a spring, and a lower surface or section of the tub 122 may be supported by a supporting member 140. The supporting member 140 may be a damper that absorbs and/or reduces shocks and/or vibrations generated by rotation of the drum 121 or the like.

The angle adjusting unit 200 having a function of adjusting an angle of the main body 100 from the ground may include a base 210 and a driver 220 configured to pivot (tilt up) the main body 100. In exemplary embodiments, a cylinder device (e.g., a hydraulic cylinder or other piston-based device) is an example of the driver 220, but in other exemplary embodiments, the driver 220 may comprise other drivers or driving devices such as a motor. Hereinafter, for the convenience of explanation, the driver 220 will be referred to as the cylinder device 220.

The base 210 defines a bottom surface of the drum type washing machine 10 and may support the main body 100. As an example, the base 210 may include a base plate 211 on which the main body 100 rests or is settled (e.g., in the absence of being tilted), one pair of side plates 212 at each side surface(s) of the base plate 211, and a rotational shaft 213 oriented or extending side-to-side across the cabinet and/or horizontally to the ground.

The base 210 may be connected with the cabinet 110 through the rotational shaft 213, and the rotational shaft 213 may connect the side plates 212 and a rear lower end of the cabinet 110. Therefore, the cabinet 110 may be pivoted about the rotational shaft 213 (e.g., which acts as a hinge or pivot). The main body 100 may be pivoted (tilted up) around an axis located in the rear lower end of the cabinet or main body.

The cylinder device 220 lifts the main body 100 up and down (e.g., the front end of the main body 100) so that the main body 100 may be pivoted up and down. In addition, the cylinder device 220 may be disposed in an installation space 112 between the base 210 and the bent or sloped surface 111. The cylinder device 220 includes a piston 222 which may reciprocate (e.g., drive an arm or rod that goes in and out of the cylinder).

An end of the piston 222 and the cabinet 110 may be connected with each other through a hinge 221. The hinge 221 may rotate or slide forward and backward so that an angle of the main body 100 from the ground changes when the main body 100 is lifted up and down. For example, a rail or slot extending in a front-to-rear direction is on or in the bottom surface of the cabinet 110, and the hinge 221 may be coupled to the rail or slot and move along the rail or slot.

The cylinder device 220 is coupled to the bottom surface of the cabinet at a front side of the rotational shaft 213, and thus the main body 100 may pivot upwardly about the rotational shaft 213 when the piston 222 moves up.

At this time, as a distance between the cylinder device 220 and the rotational shaft 213 decreases or becomes shorter, a tilting angle of the main body 100 from the ground increases or becomes greater, assuming a lifting displacement of the piston 222 is the same. Therefore, to increase the tilting angle of the main body 100 from the ground, the distance between the cylinder device 220 and the rotational shaft 213 should be short, and to reduce the tilting angle of the main body 100, the distance between the cylinder device 220 and the rotational shaft 213 should be long, whereby it is possible to effectively adjust the tilting angle of the main body 100 from the ground. In addition, the tilting angle of the main body 100 may be adjusted by increasing or reducing the lifting displacement of the piston 222.

Hereinafter, operations and effects of the drum type washing machine according to exemplary embodiments of the present disclosure will be described.

The main body 100 may be pivoted upwardly by controlling the control panel 130 when a user washes or collects laundry from the drum type washing machine 10.

The main body may be pivoted upwardly by the driver 220, i.e., the cylinder device 220. More specifically, if the cylinder device 220 is driven, the piston 222 moves up and pushes the main body 100 upwardly, and the hinge 221 may rotate or slide in a predetermined distance toward the front side of the main body 100. Therefore, since an external force is applied to the main body 100 upwardly in front of the rotational shaft 231, which is a rotational center, the main body 100 pivots upwardly (e.g., in a clockwise direction of FIG. 3).

Therefore, the drum 121 tilts up more than before adjusting the angle of the main body 100, and the door 123 opens more upwardly than before. Therefore, the user may more conveniently open the door 123.

Furthermore, since the drum 124 also pivots upwardly together with the door 123, the user may open the door 123 and then may conveniently place the laundry in the drum 124 or may remove the laundry out of the drum 124.

Particularly, in exemplary embodiments, the user's back does not have to bend as much when the user places the laundry into the drum 124 or removes the laundry out of the drum 124, thus reducing the risk of injury and/or strain to the user's back.

Furthermore, since the user may conveniently check the inside of the drum 124, laundry being accidently left in the innermost end of the drum 124 when the user takes the laundry out of the drum 124 is minimized.

Furthermore, when the user places a large amount of the laundry in the drum 124 of a conventional drum type washing machine, the user has to push the laundry to a rear side of the drum 124 horizontally. However, in the exemplary embodiments of the present disclosure, the laundry naturally moves to the innermost end of the drum 124 by gravity when placing laundry into the drum 124, thus the user may easily place larger amounts of laundry into the drum 124.

Since a space between the cabinet 110 and the base 210, which may be exposed by the lifting-up of the main body 100, may be blocked by the front blocking plate 113 and the one or more side blocking plate(s) 114, foreign substances can be prevented from entering the cylinder device 220, minimizing mal-function of the cylinder device 220.

If the laundry is completely placed in or removed from the drum 124, the user may operate the control panel 300 to return the main body 100 to its original position. More specifically, the cylinder device 220 may move the piston 222 down and the hinge 221 may rotate or slide to a rear side of the main body 100, and the main body 100 may be tilted down along the rotational shaft 213 in a counter-clockwise direction, and then settle on the base 210.

A washing process of the drum type washing machine 10 is carried out when the main body 100 is settled on the base 210. At this time, since the drum 124 is rotated when the rotational axis thereof parallel with the ground, the washing process may be stably performed.

Hereinafter, a drum type washing machine according to other exemplary embodiments of the present disclosure will be described with reference to FIG. 5. However, since a base 210' and a cylinder device 220' of the exemplary embodiments is different from those of the previous exemplary embodiments, the differences are mainly described, and the same reference numerals are given to the same or corresponding parts in both exemplary embodiments.

Figure 5:
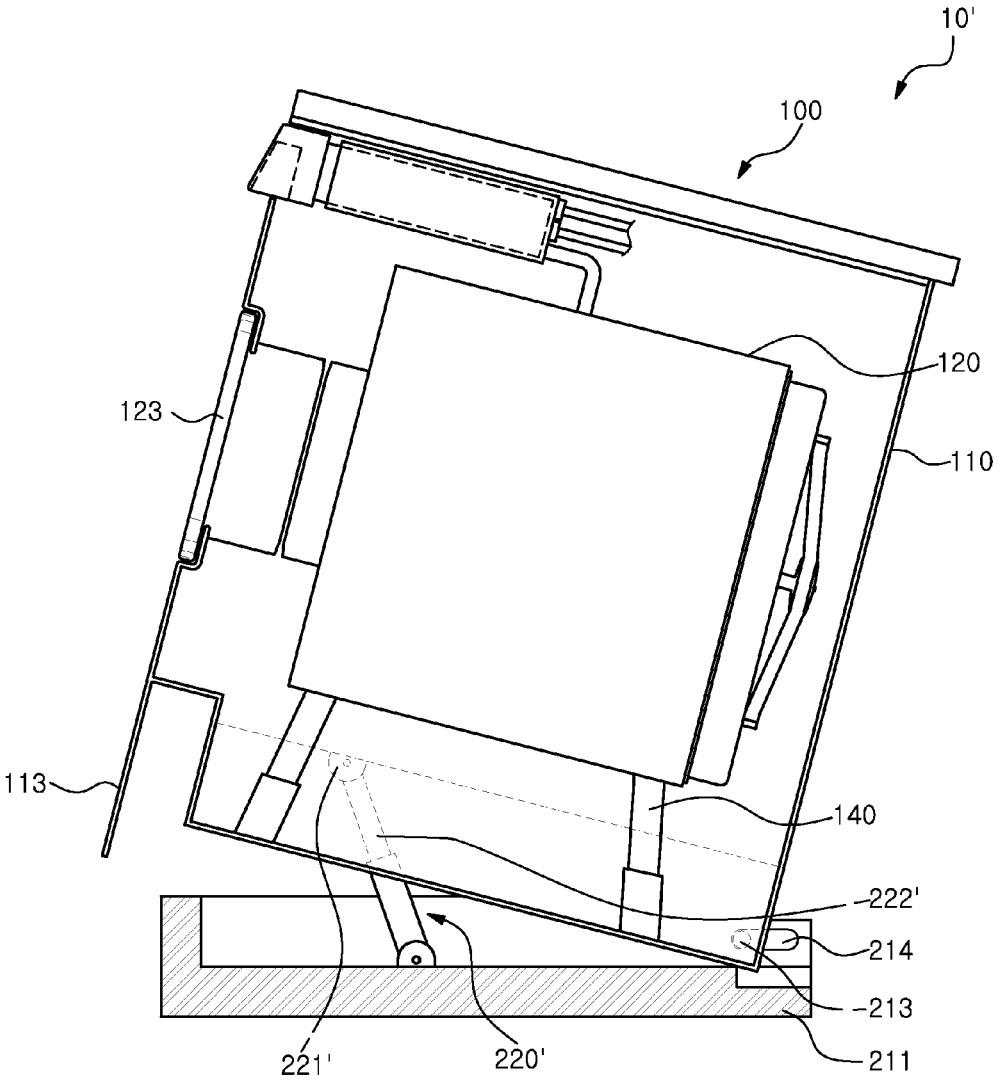
FIG. 5 is a cross-sectional view schematically illustrating a side surface of the washing machine according to other exemplary embodiments of the present disclosure.

FIG. 5 is a cross-sectional view schematically illustrating a side surface of a washing machine 10' according to other exemplary embodiments of the present disclosure.

Referring to FIG. 5, the drum type washing machine 10' according to other exemplary embodiments of the present disclosure includes the main body 100 and an angle adjusting unit 200' configured to tilting the main body 100.

The angle adjusting unit 200' may include a base 210' that the main body is settled and a cylinder device 220' configured to lift the main body 100 up and down.

The base 210' may be connected with the main body 100 through a rotational shaft 213' extending in a side-to-side direction between a pair of side plates 212', and the side plate 212' may have a guide groove 214 which guides the rotational shaft 213' in a horizontal forward and backward direction.

The cylinder device 220' tilted in a forward direction may be connected with the main body 100. Thus, when the piston 222' moves up, the main body 100 is lifted up accordingly. The main body 100, while being lifted up, moves to a forward direction and/or location together with the rotational shaft 213', as the piston moves up.

Although the main body 100 pivots by the rotational shaft 213' and the rear end of the main body 100 is inclined toward the rear side, the main body 100 is prevented from interfering with an object (e.g., wall) located at the rear side of the main body 100 because the main body 100 moves to the front side.

As described above, in the drum type washing machine 10' according to other exemplary embodiments of the present disclosure, when the washing machine 10' is installed at a desired place, it is not necessary to secure a large rear space for the drum type washing machine 10', and thus it is possible to enhance space efficiency.

Furthermore, the exemplary embodiments of the present disclosure advantageously provide a drum type washing machine capable of readily placing the laundry in the drum and removing laundry out of the drum.

Although exemplary embodiments of the present disclosure are described above with reference to the accompanying drawings, those skilled in the art will understand that the present disclosure may be implemented in various ways without changing the necessary features or the spirit of the present disclosure. The scope of the present disclosure will be interpreted by the claims below, and it will be construed that all techniques within the scope equivalent thereto belong to the scope of the present disclosure.

What is claimed is:

1. A drum type washing machine, comprising:

a main body comprising a cabinet, a drum in the cabinet wherein a rotational axis of the drum is parallel with the ground, and a motor configured to move the drum;

a rail on the bottom surface of the cabinet and extending in a rear-to-front direction;

a hinge coupled to the rail and configured to move backward and forward along the rail; and an angle adjusting unit configured to adjust an angle of the main body relative to the ground, wherein the angle adjusting unit comprises:

a base configured to support the main body; and a driver on the base configured to tilt the main body, wherein the angle adjusting unit is configured to tilt the main body at a rear lower end of the cabinet, wherein a rotational shaft is coupled to the cabinet between side surfaces of the cabinet, wherein further the base has a guide groove in which the rotational shaft rotates and slides in the rear-to-front direction of the cabinet, and wherein the driver is rotatably connected to the hinge.

2. The drum type washing machine of claim 1, wherein the driver is a cylinder device spaced apart or separated from the rotational shaft and configured to lift the cabinet up and down.

3. The drum type washing machine of claim 2, wherein the cylinder device includes a piston configured to reciprocate bidirectionally.

4. The drum type washing machine of claim 3, wherein the piston comprises a first end rotatably connected to the hinge.

5. The drum type washing machine of claim 2, wherein the cylinder device is rotatably connected to the base.

6. The drum type washing machine of claim 1, wherein a front blocking plate extends from a front surface of the cabinet to block a space between the front blocking plate and the base, and wherein one or more side blocking plates extend from respective side surface(s) of the cabinet to block a space between the side blocking plates and the base.

7. The drum type washing machine of claim 6, wherein the one or more side blocking plate(s) include a side blocking plate that is proximate to the rotational shaft and configured to protect the rotational shaft.

8. The drum type washing machine of claim 1, wherein a bottom surface of the cabinet includes a sloped surface to form an installation space between the sloped surface and a base plate of the base.

9. The drum type washing machine of claim 8, wherein the driver of the angle adjusting unit is in the installation space between the sloped surface and the base plate.

10. The drum type washing machine of claim 3, wherein the angle between the main body and the ground increases as displacement of the piston from the cylinder device increases.

11. The drum type washing machine of claim 3, wherein the angle between the main body and the ground decreases as displacement of the piston from the cylinder device decreases.

12. The drum type washing machine of claim 1, further comprising a control panel configured to receive an instruction to pivot the washing machine, cabinet and/or main body upwardly.

13. The drum type washing machine of claim 3, wherein when the cylinder device moves the piston down, the hinge slides toward the rear side of the main body.

14. The drum type washing machine of claim 1, wherein the angle adjusting unit is configured to tilt the main body at the rear lower end of the cabinet by pivoting the main body about the rotational shaft, causing the rotational shaft to rotate, move and slide along in the rear-to-front direction in the guide groove when the angle of the main body is adjusted and/or when the main body is tilted up to the angle.

* * * * *